United States Patent [19]

Nordin

[11] 4,024,714

[45] May 24, 1977

[54] VALVE MECHANISM

[76] Inventor: Lars-Gunnar Nordin, 4 Drejargatan, S-113 42 Stockholm, Sweden

[22] Filed: June 6, 1975

[21] Appl. No.: 584,441

Related U.S. Application Data

[63] Continuation of Ser. No. 450,538, March 12, 1974, abandoned.

[30] Foreign Application Priority Data

Mar. 12, 1973 Sweden ..... 7303429

[52] U.S. Cl. ..... 60/572
[51] Int. Cl.[2] ..... F15B 7/10
[58] Field of Search ..... 60/572, 592; 137/522; 251/61.3

[56] References Cited

UNITED STATES PATENTS

| | | | |
|---|---|---|---|
| 2,327,542 | 8/1943 | Matteson | 251/61.3 X |
| 2,540,879 | 2/1951 | Hebel et al. | 60/572 |
| 3,317,181 | 5/1967 | Robbins, Jr. | 251/63.4 |

FOREIGN PATENTS OR APPLICATIONS

| | | | |
|---|---|---|---|
| 487,288 | 10/1952 | Canada | 60/572 |
| 56,263 | 3/1936 | Norway | 137/522 |

*Primary Examiner*—Arnold Rosenthal
*Attorney, Agent, or Firm*—Fred Philpitt

[57] ABSTRACT

A valve mechanism disposed between two pressure sides of a system making it possible for excess pressure device to leave one side of the system to a pressure medium source during a working period of the system. This excess pressure may either be caused by a temperature rise or by a change in the internal volume of the system.

1 Claim, 1 Drawing Figure

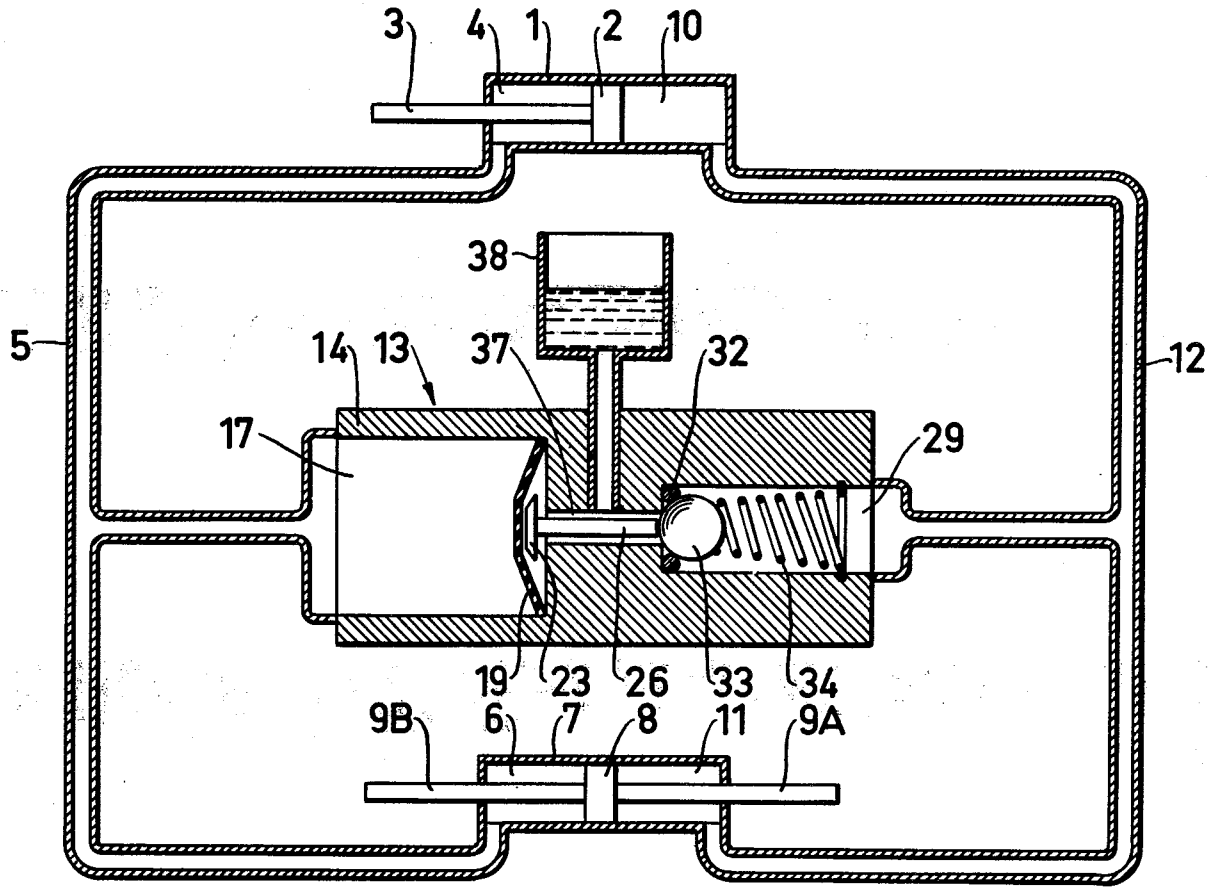
12
29
34
9A
32
33
11
10
26
8
2
23
7
1
37
19
6
4
38
3
13
9B
14
17
5

VALVE MECHANISM

This is a continuation of application Ser. No. 450,538, filed Nov. 12, 1976 now abandoned. This invention relates to a valve mechanism, useful for example in connection with a hydraulic control system where movements from a master unit in a hydrostatic way is transferred via two pipes to a slave unit.

Such a valve mechanism is known generally from the Swedish patent 316378. This well-known regulator has, when it is used in the above mentioned hydraulic control system, a disadvantage. When pressure medium has left the two pipes to the pressure medium source, it is not certain that the same amount of pressure medium will be brought back to the pipe where it came from. This can have the effect of changing the relative position between master and slave unit. In an extreme situation it may happen that pressure medium is let out from one pipe only to the pressure medium source, and leaves the source for the other pipe only.

These disadvantages are eliminated by the valve mechanism of the present invention. There is only one connection between the pressure system and the pressure medium source. Master and slave units have no chances of changing their relative position, as there cannot be any overflow via the source from one side of the system to the other.

An embodiment of the invention will be described hereinafter, with reference to the drawing. The FIGURE schematically shows a control system with two double acting cylinders and their connecting pipes and in a larger scale, as a part of the system, a valve mechanism.

In the FIGURE, 1 stands for a cylinder, in which is placed a movable piston 2 and its rod 3. The left chamber 4 of the cylinder 1 is connected with a pipe 5 to one chamber 6 of another cylinder 7, also with a piston 8 but with two rods 9B and 9A. The right sides 10 and 11 of the cylinders 1 and 7 are interconnected with a pipe 12.

The arrangement can for example be used for the transfer of movements of a steering wheel or like to wheels, rudders or the like. The rod 3 can be connected to the steering wheel and the rods 9A or 9B to the rudder. For example, when the rod 3 is moved to the right, the rod 9B will move to the left by means of the fluid that will be pressed out from chamber 10 into chamber 11 via the pipe 12.

Parallell with the cylinders 1 and 7 between the pipes 5 and 12 is a valve mechanism 13 interconnected for controlling the pressure in the hydraulic system, and which comprises a body 14 in the middle of which is drilled a passage 37.

In this passage 37 is placed a pin 26 with a head 23, which head faces a rubber membrane 19 which is sealed relative to the walls of chamber 17.

In the right chamber 29 is a valve seat 32 and a ball 33 spring loaded by a spring 34.

From the passage 37 there is a connection to a pressure medium source 38.

The valve mechanism described works as follows: Suppose that a movement from the rod 3 should be transmitted to the rods 9A and 9B and that the rod 3 is moved to the right. This makes a pressure increase in pipe 12.

The cylinders 1 and 7 are supposed to have the same internal diameter. Owing to the volume that the rod 9A takes in chamber 11 the piston 8 will move more rapidly to the left than the piston 2 to the right. The consequence of this is that a pressure increase arises in the pipe 5 — the rods 9B and 3 are supposed to have the same diameter — which moves the membrane 19 to the right and makes the pin 26 lift the ball 33 from its seat 32 and permits the increase in volume in the right side of the system to pass by to the pressure medium source 38.

If in the FIGURE rod 9A is omitted, no change in volume would occur, and the ball 33 should have been closed all the time by the increase of the pressure in pipe 12.

When the rod 3 is moved to the left, there is a pressure increase in pipe 5 and the membrane 19 is pressed against the bottom of chamber 17, the head 23 covers the opening of the passage 37 and the pin 26 lifts the ball 33 from its seat 32 and opens a communication between pipe 12 and the pressure source 38. When the piston 2 moves to the left, piston 8 will move with the same speed to the right. However, chamber 11 gives off less pressure medium than chamber 10 will take up and the difference in volume between chamber 11 and 10 will be compensated by the source 38, which continually adds pressure medium to pipe 12.

If in the pipes 5 and 12 a simultaneous over pressure should arise, for example by thermal expansion of the pressure medium the membrane 19 with the pin 26 will lift the ball 33, and the pressure medium from pipe 12 can by-pass ball 33 to source 38. The excess pressure in pipe 5 will be let out via the pistons 2 and 8, which will move somewhat in direction towards pipe 12.

Again if the temperature in the hydraulic system decreases, then the pressure in pipes 5 and 12 will be lower than the pressure in source 38. pressure medium will be brought back to pipe 12 via ball 33, now working as a return vent.

What I claim is:

1. A master-slave hydrostatic movement transmitting system which comprises in combination:

a. a master unit which exerts hydraulic pressure when moved, b. a slave unit which moves by virtue of the pressure exerted by the master unit, c. a first pipe connecting a first side of said master unit with a first side of said slave unit, d. a second pipe connecting a second side of said master unit with a second side of said slave unit, e. said master unit and said slave unit each including a piston movable back and forth within a piston cylinder, the piston in said master unit having a piston rod on only one side of its piston while the slave unit has a piston rod on both sides of its piston, f. a passageway extending between said first pipe and said second pipe, g. a movable barrier extending across said passageway so as to at all times block liquid flow between said first and second pipes and so as to divide said passageway into a first passageway portion and a second passageway portion, said first passageway portion and said second passageway portion being entirely separate from each other, said barrier being partially movable within said passageway under the influence of the liquid pressure in either of said passageway portions, h. a liquid reservoir, i. said liquid reservoir being connected to said first passageway portion and not to said second passageway portion, said connection between said reservoir and said first passageway portion consisting of a conduit between said reservoir and said first passageway portion, j. a valve mechanism resiliently mounted in said first passageway portion for controlling the flow of fluid through said first passageway portion for biasing said valve mechanism toward a closed position, valve opening means extending between said movable barrier and said valve mechanism so that movement of the movable barrier in one addition will cause said valve opening means to move said valve mechanism against its resilient mounting and open said first passageway portion to the flow of fluid between said reservoir and said first pasageway portion.

* * * * *